US005501539A

United States Patent [19]

Day

[11] Patent Number: 5,501,539

[45] Date of Patent: Mar. 26, 1996

[54] TAPE CUTTING APPARATUS

[75] Inventor: Robert C. L. Day, Cambridge, United Kingdom

[73] Assignee: Esselte Dymo N.V., St. Niklaas, Belgium

[21] Appl. No.: 266,822

[22] Filed: Jun. 27, 1994

[30] Foreign Application Priority Data

Jul. 12, 1993 [GB] United Kingdom ..... 9314388

[51] Int. Cl.[6] ..... B41J 15/00; B41J 35/28

[52] U.S. Cl. ..... 400/621; 400/613; 400/208

[58] Field of Search ..... 400/208, 613, 400/621, 621.1, 621.2; 83/DIG. 1, 694, 699.11, 937; 346/24

[56] References Cited

U.S. PATENT DOCUMENTS

| | | | |
|---|---|---|---|
| 2,913,299 | 11/1959 | Clift, Jr. | 346/24 |
| 3,237,494 | 3/1966 | Norvelle | 400/621 X |
| 4,537,582 | 8/1985 | Liu | 83/DIG. 1 X |
| 4,815,874 | 3/1989 | Richardson et al. | 400/208 |
| 4,907,014 | 3/1990 | Tzeng et al. | 400/621 X |
| 5,209,151 | 5/1993 | Takagi et al. | 400/621 X |
| 5,333,959 | 8/1994 | Yamaguchi et al. | 400/208 |
| 5,348,406 | 9/1994 | Yoshiaki et al. | 400/621 X |

FOREIGN PATENT DOCUMENTS

| | | | |
|---|---|---|---|
| 2098565 | 8/1974 | France | 83/DIG. 1 |

*Primary Examiner*—Christopher A. Bennett

[57] ABSTRACT

A blade protection device is described for protecting a cutting blade in a printing device which is actuatable so that a blade protection member is movable by insertion of a cassette into the printing device. A printing device has a cassette receiving bay for receiving a cassette of tape and a cutting blade for receiving a cassette of tape and a cutting blade for cutting the tape after printing. The printing device incorporates a blade protection device such as described above. Cassettes are also described which are adapted to actuate the blade protection device described above when inserted into a printing device. One cassette has an aperture which receives an upstanding part of the blade protection member. Another cassette has a depending part which locates a surface of the blade protection member to actuate the blade protection device when the cassette is inserted into a printing device.

18 Claims, 3 Drawing Sheets

FIG. 1.
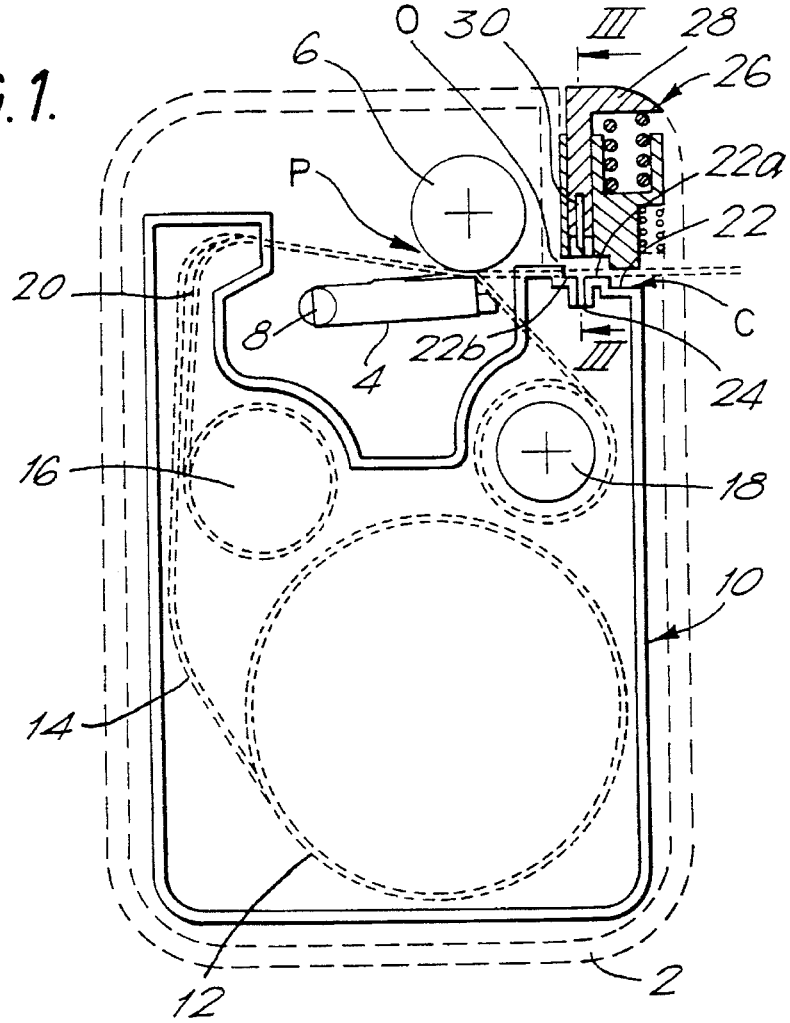
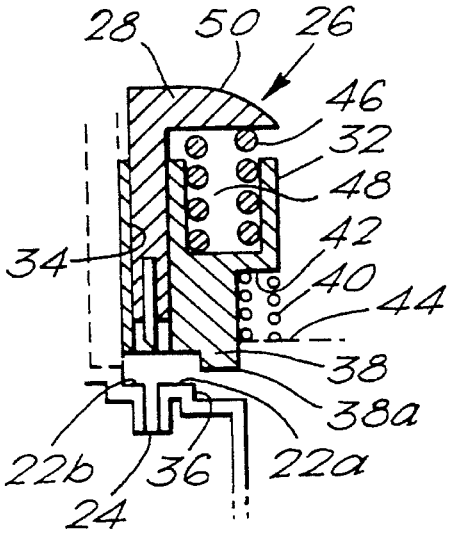
FIG. 2.

FIG. 3.
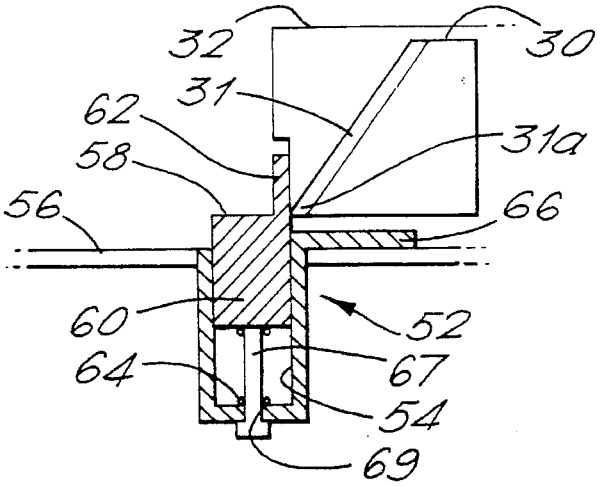
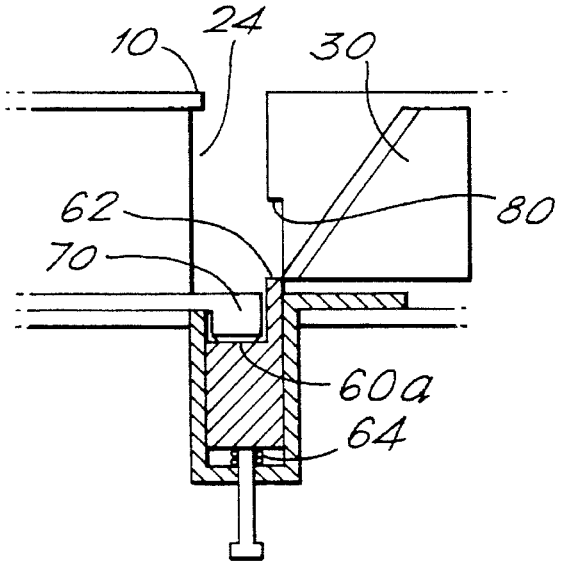
FIG. 4.
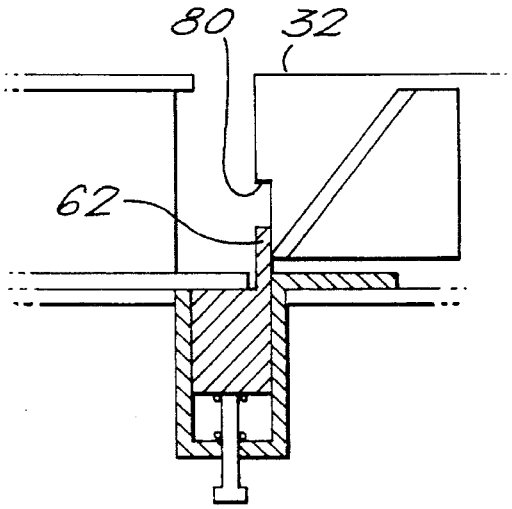
FIG. 5.

TAPE CUTTING APPARATUS

BACKGROUND TO THE INVENTION

The present invention relates to tape cutting apparatus and is particularly but not exclusively concerned with a tape cutting apparatus used in thermal printing devices.

FIELD OF THE INVENTION

Thermal printing devices of the type with which the present invention is primarily concerned operate with a supply of tape arranged to receive an image and a means for transferring an image onto the tape. In one form, a tape holding case holds a supply of image receiving tape and a supply of an image transfer ribbon, the image receiving tape and the transfer ribbon being passed in overlap through a printing zone of the printing device. A printing device operating with a tape holding case of this type is described for example in EP-A-0267890 (Varitronics, Inc.). Other printing devices have been made in which letters are transferred to an image receiving tape by a dry lettering or dry film impression process. In all of these printing devices, the construction of the image receiving tape is substantially the same. That is, it comprises an upper layer for receiving an image which is secured to a releaseable backing layer by a layer of adhesive. Once an image or message has been printed on the tape, it is desired to cut off that portion of the tape to enable it to be used as a label.

Various cutting mechanisms have been disclosed for performing this function. In EP-A-0267890, cooperating scissor blades are used to cut off a portion of the tape. In EP-0322919, a blade mounted on a cutter support member is used to cut the tape, with the tape supported by an anvil. As described in EP-A-0364305 the anvil is provided by part of the cassette wall. The anvil can alternatively be part of the printing device or a separate component altogether. There have been found to be disadvantages relating to these cutting methods, and the present inventors have found that it is preferable to cut the tape using a blade which enters a slot below the tape rather than acting against an anvil. In this respect, reference is made to our copending application Ser. No. 08/266,828, filed Jun. 27, 1994, the contents of which are herein incorporated by reference.

When cutting a tape by moving a blade through the tape into a slot, it is advantageous if the blade is sharp and angled. Moreover, the blade remains sharp during the life of the printing device as it is not blunted by action against an anvil. Moreover, as the blade is required to travel through a distance through the tape and into the slot, it cannot be wholly concealed throughout its travel. Thus, the blade could possibly present a safety hazard. The present invention is intended to overcome any possible difficulties associated with having the blade exposed in the printing device.

SUMMARY OF THE INVENTION

According to the present invention there is provided a blade protection device comprising a blade protection member mounted for movement relative to a cutting blade so as to prevent movement of the blade in a first position and to allow movement of the blade in a second position, the blade protection member being movable between the first and second positions by cooperation of a tape holding case with the blade protection device.

Preferably the blade protection member is mounted for movement in a channel member located in the floor of a cassette receiving bay so that the blade protection member protrudes above the floor in the first position and does not protrude above the floor in the second position. Preferably, the blade protection member lies flush with the floor in the second position. The present invention also provides a printing device having a blade protection device as defined herein. The printing device is cooperable with a cassette which is formed so that when it is inserted into the cassette receiving bay it moves the blade protection member from the first to the second position.

Preferably, the blade protection member is resiliently mounted within the channel member so that it is biased into the first position.

In another embodiment, the blade protection member has an upstanding part which is pushed down by the base of a cassette. In this embodiment the blade protection member can have a second upstanding part which extends through an aperture in the base of a specially designed cassette. If an attempt is made to insert a cassette without such an aperture in its base, it will not be possible to do this because the second upstanding part will prevent the insertion.

The blade protection device is preferably designed so that the protection member is not moved from the first to the second position except by insertion of a proper cassette.

In one embodiment, the cassette has a depending part which locates a surface of the blade protection member and causes it to move against the action of a spring into the channel member.

For a better understanding of the present invention and to show how the same may be carried into effect, reference will now be made by way of example to the accompanying drawings.

BRIEF DESCRIPTION OF THE DRAWINGS

FIG. 1 is a plan view illustrating a printing device for use with the present invention;

FIG. 2 shows the cutting mechanism in more detail;

FIGS. 3 and 4 are cross-sections through a blade protection device in the first and second positions;

FIG. 5 is a cross-section through a blade protection device when actuated with an incorrect cassette;

DESCRIPTION OF THE PREFERRED EMBODIMENT

Figure 6:
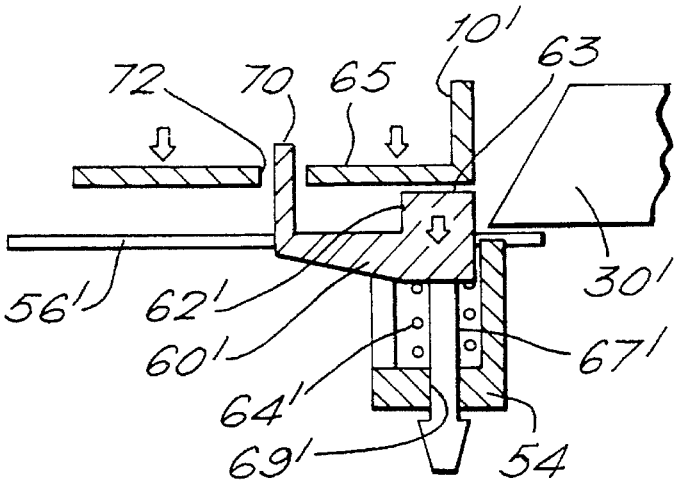
FIG. 6 illustrates in section another embodiment of a blade protection device.

FIG. 1 illustrates in plan view a cassette bay of a printing device. The cassette bay is shown by the dotted line 2. The cassette bay includes a thermal print head 4 and a platen 6 which cooperate to define a print location P in a manner which is known in the art. The print head 4 is pivotable about a pivot point 8 so that it can be brought into contact with the platen 6 for printing and moved away from the platen to enable a cassette to be removed and replaced.

A cassette inserted into the cassette bay 2 is denoted generally by reference numeral 10. The cassette holds a supply spool 12 of image receiving tape 14 which comprises an image receiving layer secured to a backing layer by a layer of adhesive. The image receiving tape 14 is guided by a guide mechanism (which is not shown) through the cassette, out of the cassette through an outlet O, past the print location P to a cutting location C. The cassette 10 also has an ink ribbon supply spool 16 and an ink ribbon take up spool 18. The ink ribbon 20 is guided from the ink ribbon supply spool 16 through the print location P and taken up on the ink ribbon take up spool 18. The image receiving tape 14 passes in overlap with the ink ribbon 20 through the print location P with its image receiving layer in contact with the ink ribbon.

In the printing device illustrated in FIG. 1, the platen 6 is driven so that it rotates to drive the image receiving tape 14 past the print location P during printing. In this way, tape is printed and fed out from the print location P to the cutting location C. In contrast to carrier devices, the cutting location C is provided at a location on a portion of the wall of the cassette 10 which is close to the print location P. As the tape is fed out of the cassette by driving the platen 6, there is no need for a further feed mechanism for the tape and this enables the cutting location C to be closer to the print location P. In the described embodiment, the distance between the cutting location and the print location can be 9 mm. The portion of the wall of the cassette 10 where the cutting location C is defined is denoted by reference numeral 22. A slot 24 is defined in this wall portion and the image receiving tape 14 is fed past the print location P to the cutting location C where it is supported by facing wall portions 22*a*,22*b* on either side of the slot 24.

The printing device includes a cutting mechanism denoted generally by reference numeral 26. This cutting mechanism includes a cutter support member 28 which carries a blade 30. The design of the blade 30 can be seen more clearly in FIGS. 3 and 4. The blade 30 has a sharpened and angled cutting edge 31. The blade 30 cuts the image receiving tape 14 and then enters the slot 24 with the leading part 31*a* of its edge 31 first, rather than bearing against an anvil.

FIG. 2 shows the cutting mechanism 26 in more detail. The cutting mechanism comprises with the cutter support member 28 a tape clamp 32. The cutter support member 28 is mounted for movement within a slot 34 in the tape clamp 32. The portion 22 of the cassette wall 10 defining the cutting location C has adjacent one of the facing surfaces 22*a* a stepped portion 36 which cooperates with a stepped portion 38 in the tape clamp 32 in a manner which will be described more clearly hereinafter. A relatively weak spring 40 is located between a ledge 42 of the tape clamp 32 and a cooperating ledge 44 of the casing 2. A relatively stiff spring 46 is located in a recess 48 of the tape clamp 32 to act against the cutter support member 28. The cutter support member provides a surface which is preferably formed in the shape of a button 50 or the like and which can be depressed by a user using manual force.

As will be readily appreciated, when the tape is to be cut, the button 50 is depressed, pushing the blade 30 towards the tape, through the tape to cut it and into the slot 24. When a cassette 10 is inserted into the printing device 2 the blade is not readily accessible and so does not present a safety hazard. However, when there is no cassette in the printing device, the blade can be exposed if the button 50 were to be inadvertently actuated, could present a safety hazard. Thus, the present invention provides a blade protection device which is illustrated in FIGS. 3 to 5. These figures are taken at a diagrammatic section along line III—III of FIG. 1.

A blade protection device 52 is mounted in an aperture in the cassette bay floor, forming part of the printing device 2 and denoted by reference numeral 56. The blade protection device 52 comprises a channel member defining a channel 54 and having a ledge 66 which is supported by the cassette bay floor 56. The blade protection device also includes a safety guard 58 having a body 60 and an upstanding blade protection part 62. FIG. 3 illustrates the blade protection device in its operative position. The body 60 of the safety guard 58 is mounted on a shaft 67 slidable in an aperture 69 formed in the base of the channel 54. It is held in the upward position by a compression spring 64. In this position, the blade protection part 62 is located against the tip 31*a* of the blade 30 to prevent actuation of the blade to bring it to an accessible position. Reference numeral 32 denotes the part of the tape clamp located on the left hand side of the cutter support in FIGS. 1 and 2.

FIG. 4 shows the case when a cassette 10 has been inserted into the cassette bay of the printing device. The cassette 10 carries a protrusion 70 on its underside which acts against the upper surface 60*a* of the body 60 of the safety guard to move it downwardly within the channel against the action of the compression spring 64. This thus moves the blade protection part 62 downwardly and allows the blade 30 to be moved forward to cut the tape.

The blade protection device is designed so that the printer can only be used with correctly designed cassettes, namely, in this embodiment, cassettes having a protrusion capable of acting on the body of the safety guard to push it downwardly. FIG. 5 shows the case where a cassette having a flat base is inserted. The body of the blade protection device is pushed down only part way, still preventing free movement of the blade. To prevent a user from pushing the blade protection device fully by other means, the blade protection part 62 is located in a recessed part 80 of the tape clamp 32 so that it is not accessible from above.

As an alternative to this, the compression spring can be designed so that it is fully compressed at a height which is too great to allow the safety guard to be pressed fully downwardly by action on the upper surface of blade protection part 62 so as to prohibit free movement of the blade.

Figure 7:
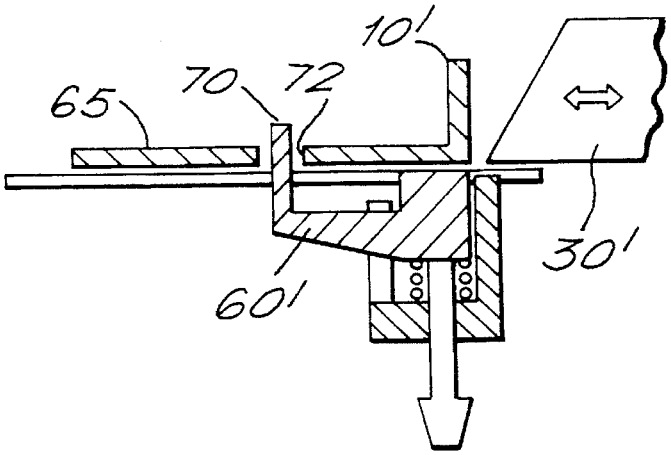
FIG. 7 illustrates in section the blade protection device of FIG. 6 in the "in use" position.
Figure 8:
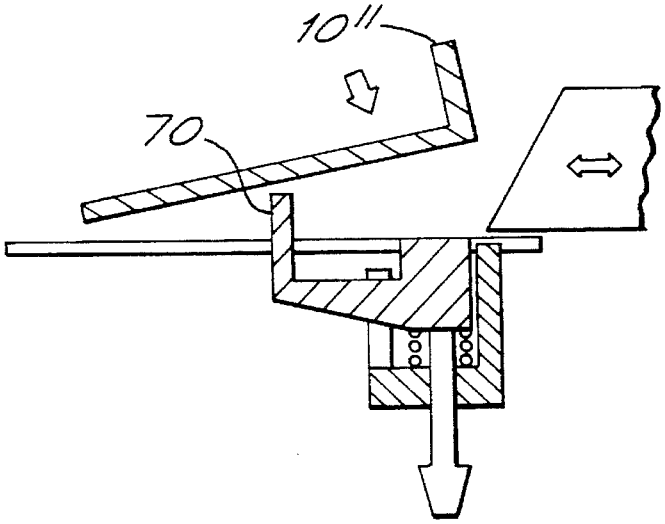
FIG. 8 illustrates the blade protection device of FIG. 6 when an attempt to insert an incorrect cassette is made.

Reference will now be made to FIGS. 6 to 8 to describe an alternative embodiment of the present invention. In FIGS. 6 to 8, numerals representing like parts as the embodiment of FIGS. 3 to 5 are indicated by the same reference numerals, but primed. The embodiment of FIGS. 6 to 8 differs from the embodiment of FIGS. 3 to 5 in that the body 60' of the blade protection device has an upstanding blade protection part 62' which has a horizontal upper surface 63 which performs a similar function to 60*a* in FIG. 4. However, as will readily be appreciated, the horizontal surface 63 can be actuated by the flat base 65 of a cassette 10'. Thus, the cassette is not required to have any depending part or protrusion such as that designated by reference numeral 70 in FIG. 4.

Nevertheless, it is still desirable to design the machine so that it can only receive specially designed cassettes. To that end, the blade protection device includes a second upstanding part 70 which is intended to extend through an aperture 72 in the base 65 of the cassette 10'. The arrows in FIG. 6 illustrate that insertion and downward movement of the cassette 10' cause the body 60' of the blade protection device to be pushed downwardly against the action of the spring 64' to release the blade 30' for operation. To that extent, operation is similar to the embodiment of FIGS. 3 to 5.

FIG. 7 illustrates the cassette fully inserted into the machine in the ready-to-use position.

FIG. 8 illustrates what happens when an attempt is made to insert an incorrect cassette 10", that is one without an aperture in its base equivalent to aperture 72. It is not possible to insert this cassette into the machine because the upstanding part 70 of the blade protection device will prevent the insertion. Thus, the machine will only operate with specially designed cassettes.

What is claimed is:

1. A printing device in combination with a cassette, wherein said cassette is removably received in a cassette receiving bay of the printing device, said cassette holding a supply of tape and the printing device further comprising a cutting blade for cutting said tape after printing, and a blade protection device comprising a blade protection member mounted for movement relative to the cutting blade so as to prevent movement of the blade in a first position and to allow movement of the blade in a second position, the blade protection member being movable between the first and second positions by insertion of said cassette into the cassette receiving bay.

2. A combination according to claim 1 wherein the cassette receiving bay has a floor, the blade protection device further comprises a channel member located in the floor of the cassette receiving bay and the blade protection member is mounted for movement in the channel member located in the floor of the cassette receiving bay so that the blade protection member protrudes above the floor in the first position and does not protrude above the floor in the second position.

3. A combination according to claim 2 wherein the blade protection member is resiliently mounted within the channel member so that it is biased into the first position.

4. A combination according to claim 2 wherein the floor of the cassette includes a depending part for locating a surface of the blade protection member and causing it to move against the action of a spring into the channel member.

5. A combination according to claim 1 wherein the blade protection member includes an upstanding part, and the cassette has an aperture for receiving said upstanding part when the cassette is inserted into the cassette receiving bay.

6. A combination as claimed in claim 1, wherein said cassette receiving bay has a floor and the blade protection member lies flush with the floor in the second position.

7. A cassette intended for use in cooperation with a printing device having a cassette receiving bay, a cutting blade for cutting the cassette tape after printing and a blade protection device comprising a blade protection member mounted for movement relative to the cutting blade so as to prevent movement of the blade in a first position and to allow movement of the blade in a second position, the cassette comprising a supply of tape;

a wall, over which said tape passes in use and on which is provided a cutting location whereat a cutting blade can cut said tape;

a base on which said supply of tape is located; and a depending part which extends from said base in the region of the cutting location so that, when the cassette is inserted into a cassette receiving bay of a printing device of the type described above, the cassette depending part locates a surface of the blade protection member and causes it to move against the action of a spring between the first and second positions.

8. A cassette intended for cooperation with a printing device having a cassette receiving bay, a cutting blade for cutting the cassette tape after printing and a blade protection device comprising a blade protection member mounted for movement relative to the cutting blade so as to prevent movement of the blade in a first position and to allow movement of the blade in a second position, the blade protection member including an upstanding member, said cassette comprising:

a supply of tape;

a wall, over which said tape passes in use and on which is provided a cutting location whereat a cutting blade can cut said tape; and a base on which said supply of tape is located, wherein said base is arranged to locate a surface of a blade protection member of a printing device of the type described above to cause said member to move against the action of a spring between the first and second positions when the cassette is inserted into a cassette receiving bay of the printing device, the cassette further having an aperture in said base and in the region of the cutting location through which said upstanding member extends.

9. A blade protection device for a printing device comprising a housing which defines a channel member; a blade protection member mounted in said channel member for linear movement between a first non-cutting position and a second cutting position; and biasing means associated with the housing for biasing said blade protection member into said first position.

10. A blade protection device as claimed in claim 9, wherein said blade protection member protrudes from said channel member when in said first position and is housed in said channel when in said second position.

11. A printing device comprising;

a cassette receiving bay for receiving a cassette which contains a supply of tape, said cassette receiving bay having a floor;

a cutting blade for cutting said tape; and a blade protection device having a channel member located in the floor of the cassette receiving bay and a blade protection member mounted for movement relative to the cutting blade so as to prevent movement of the blade in a first position and to allow movement of the blade in a second position, the blade protection device being movable between said first and second positions by insertion of a cassette into the cassette receiving bay, wherein said blade protection member is mounted for movement in the channel member so that the blade protection member protrudes above the floor of the tape supply receiving bay in the first position and does not protrude above the floor in the second position.

12. A printing device according to claim 11 wherein the blade protection member is resiliently mounted within the channel member and is biased into the first position.

13. A printing device according to claim 11 wherein the blade protection member is mounted for movement against the action of a spring into the channel member when a cassette is inserted into said cassette receiving bay.

14. A printing device comprising:

a cassette receiving bay for receiving a cassette holding tape, said cassette receiving bay having a floor for supporting said cassette;

a cutting blade for cutting said tape; and a blade protection device having a blade protection member mounted for movement relative to the cutting blade so as to prevent movement of the blade in a first position and to allow movement of the blade in a second position, the blade protection member being movable between the first and second position by insertion of a cassette into said cassette receiving bay, said blade protection member further including an upstanding part which extends upwardly from said floor of said cassette receiving bay into said bay, said upstanding part being received in an aperture of a cassette when inserted into the cassette receiving bay.

15. A printing device in combination with a cassette removably received in a cassette receiving bay of the printing device, said cassette holding a supply of tape, and having a depending part, said printing device comprising a cutting blade for cutting said tape, and a blade protection device having a blade protection member having a surface and being mounted for movement relative to the cutting blade so as to prevent movement of the blade in a first position and to allow movement of the blade in a second position, said depending part locating said surface of the blade protection member and causing the blade protection member to move between the first and second positions when the cassette is inserted into the cassette receiving bay.

16. A printing device in combination with a cassette removably received in a cassette receiving bay of the printing device, said cassette holding a supply of tape and having an aperture, said printing device comprising a cutting blade for cutting said tape after printing, and a blade protection device having a blade protection member, said blade protection member including an upstanding member and being mounted for movement relative to the cutting blade so as to prevent movement of the blade in a first position and to allow movement of the blade in a second position, the blade protection member further comprising a surface, said cassette being arranged to locate the surface of the blade protection member to cause it to move between the first and second positions when the cassette is inserted into the cassette receiving bay, the upstanding member extending into the aperture of the cassette when the cassette is inserted into the cassette receiving bay.

17. In combination, a cassette of tape and a printing device, said printing device having a cassette receiving bay for receiving said cassette, a cutting blade for cutting tape after printing and a blade protection device comprising a blade protection member mounted for movement relative to the cutting blade so as to prevent movement of the blade in the first position and to allow movement of the blade in a second position, the cassette comprising a supply of tape, a wall over which said tape passes in use and on which is provided a cutting location whereat the cutting blade cuts said tape, a base on which said supply of tape is located, and a depending part which extends from said base in the region of the cutting location so that when the cassette is inserted into the printing device it locates said surface of the blade protection member and causes it to move against the action of a spring between the first and second positions when the cassette is inserted into the cassette receiving bay.

18. In combination, a cassette of tape and a printing device, said printing device having a cassette receiving bay for receiving said cassette, a cutting blade for cutting tape after printing and a blade protection device comprising a blade protection member mounted for movement relative to the cutting blade so as to prevent movement of the blade in a first position and to allow movement of the blade in a second position, the blade protection member including an upstanding member, said cassette comprising a supply of tape, a wall over which said tape passes in use and on which is provided a cutting location whereat the cutting blade cuts said tape, and a base on which said supply of tape is located, wherein said base is arranged to locate a surface of the blade protection member to cause it to move against the action of a spring between the first and second positions when the cassette is inserted into the cassette receiving bay, the cassette further having an aperture in said base and in the region of the cutting location through which said upstanding member extends when the cassette is inserted in the printing device.

* * * * *